US006913469B2

(12) United States Patent
Chiang

(10) Patent No.: US 6,913,469 B2
(45) Date of Patent: Jul. 5, 2005

(54) CONDUCTIVE TERMINAL AND ELECTRICAL CONNECTOR APPLYING THE CONDUCTIVE TERMINAL

(75) Inventor: Chun-Hsiang Chiang, Taipei Hsien (TW)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/858,141

(22) Filed: Jun. 1, 2004

(65) Prior Publication Data

US 2004/0266225 A1 Dec. 30, 2004

(30) Foreign Application Priority Data

Jun. 5, 2003 (TW) ..... 92210307 U

(51) Int. Cl.[7] ..... H01R 12/00
(52) U.S. Cl. ..... 439/66; 439/862
(58) Field of Search ..... 439/66–68, 71–74, 439/342, 525, 591, 862, 816

(56) References Cited

U.S. PATENT DOCUMENTS 5,395,252 A * 3/1995 White ..... 439/66
5,437,556 A * 8/1995 Bargain et al. ..... 439/66
5,980,268 A * 11/1999 Mischenko et al. ..... 439/66
5,984,693 A * 11/1999 McHugh et al. ..... 439/66
6,149,443 A * 11/2000 Moran ..... 439/66
6,293,806 B1 * 9/2001 Yu ..... 439/66
6,488,513 B1 * 12/2002 Neidich et al. ..... 439/66

* cited by examiner

*Primary Examiner*—Michael C. Zarroli
(74) *Attorney, Agent, or Firm*—Robert J. Zeitler

(57) ABSTRACT

A conductive terminal is positioned in an insulative housing to constitute an electrical connector. The insulative housing is formed with a first face and a second face, and has a plurality of terminal receiving cavities. The conductive terminal includes a base abutting against the corresponding terminal receiving cavity to achieve positioning. The base has two adjacent sidewalls forming an angle therebetween. Each of the sidewalls is formed with opposite first and second edges in a direction of extension of the terminal receiving cavity. First and second resilient arms extend respectively from the first edges of the two sidewalls. The first resilient arm has a first contact portion extending from a free end. The second resilient arm extends to pass between the two sidewalls so as to form a second contact portion at a free end. The first contact portion and the second contact portion are respectively located on two sides of the base such that the first and the second contact portions electrically contact an electronic component and a circuit board, respectively, for signal transmission.

12 Claims, 3 Drawing Sheets

CONDUCTIVE TERMINAL AND ELECTRICAL CONNECTOR APPLYING THE CONDUCTIVE TERMINAL

FIELD OF THE INVENTION

This invention relates to a conductive terminal and an electrical connector using such conductive terminals, and, more particularly, to a conductive terminal applied to an LGA (land grid array) electrical connector.

BACKGROUND OF THE INVENTION

Referring to FIG. 1, U.S. Pat. No. 5,653,598 discloses an LGA (land grid array) electrical connector and a conductive terminal employed thereby, in which a tightening member (not shown) is generally used to clamp the electrical connector between a packaged integrated circuit (IC) 8 and a circuit board 9 so as to establish electrical connection without the need for a soldering step.

A bottom side of the integrated circuit 8 is formed with conductive contact pads 81 that are arranged in an array, and the circuit board 9 also has conductive contact pads 91 provided thereon at positions corresponding to the contact pads 81 of the integrated circuit 8. The integrated circuit 8 and the circuit board 9 are respectively located on two opposite upper and lower sides of the electrical connector. In addition, a plurality of terminal receiving cavities 61 are provided in an insulative housing 6 of the electrical connector and are arranged in an array form.

Each terminal receiving cavity 61 is disposed to receive a conductive terminal 7. The conductive terminal 7 includes two spaced-apart resilient arms 71, 72 and a bent portion 73 connected to one end of each of the resilient arms 71, 72 and having a measure of resiliency. Each of the resilient arms 71, 72 has a free end. A nose 711, 721 is formed at the free end to contact the contact pad 81, 91 of the integrated circuit 8 or the circuit board 9. A support arm 712, 722 extends from one nose 711 or 721 toward the other nose 721 or 711. When the integrated circuit 8 and the circuit board 9 are forced to approach the electrical connector, the conductive terminal 7 will be pressed so that the two resilient arms 71, 72 displace toward each other such that the support arms 712, 722 contact each other, thereby establishing a signal transmission path.

However, there are drawbacks with the aforesaid electrical connector. For instance, when the bent portion 73 of the conductive terminal 7 deforms, lateral deformation may also occur at the same time such that the two support arms 712, 722 move toward each other without contacting. Even though the wall surface of the terminal receiving cavity 61 can limit lateral displacement of the support arms 712, 722, the support arms 712, 722 may just scrape the wall surface of the terminal receiving cavity 61, without coming into contact with each other. Therefore, the aforesaid structure is quite unsatisfactory in terms of signal transmission stability.

Hence, the inventor has proposed another solution with respect to such an LGA electrical connector construction.

SUMMARY OF THE INVENTION

Therefore, an object of this invention is to provide a conductive terminal applied to an LGA and having preferred electrical connection stability, and an electrical connector structure.

Another object of this invention is to provide a conductive terminal capable of shortening the conducting path, and reducing resistance and inductance value to enhance signal transmission reliability, and an electrical connector applying the same.

Accordingly, the conductive terminal of this invention is positioned in an insulative housing to constitute an electrical connector. The insulative housing is formed with a first face and a second face opposite to each other, and has a plurality of terminal receiving cavities extending through the first face and the second face.

The conductive terminal includes a base for abutting against the corresponding terminal receiving cavity to achieve positioning. The base has two adjacent sidewalls forming an angle therebetween. Each of the sidewalls is formed with a first edge and a second edge opposite to each other in a direction of extension of the terminal receiving cavity. A first resilient arm and a second resilient arm extend respectively from the first edges of the sidewalls. The first resilient arm extends outwardly away from the corresponding sidewall so as to form a first contact portion capable of resilient restoration at a free end. The second resilient arm is bent to pass between the two sidewalls so as to from a second contact portion at a free end. The first contact portion and the second contact portion are respectively located on two sides of the base.

The first contact portion and the second contact portion contact electrically and respectively an electronic component and a circuit board to permit signal transmission.

Preferably, the first resilient arm can resiliently contact and is partly and spacedly adjacent to the second resilient arm such that when the first resilient arm is pressed, they can contact each other to establish a relatively short conducting path.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENTS

Figure 1:
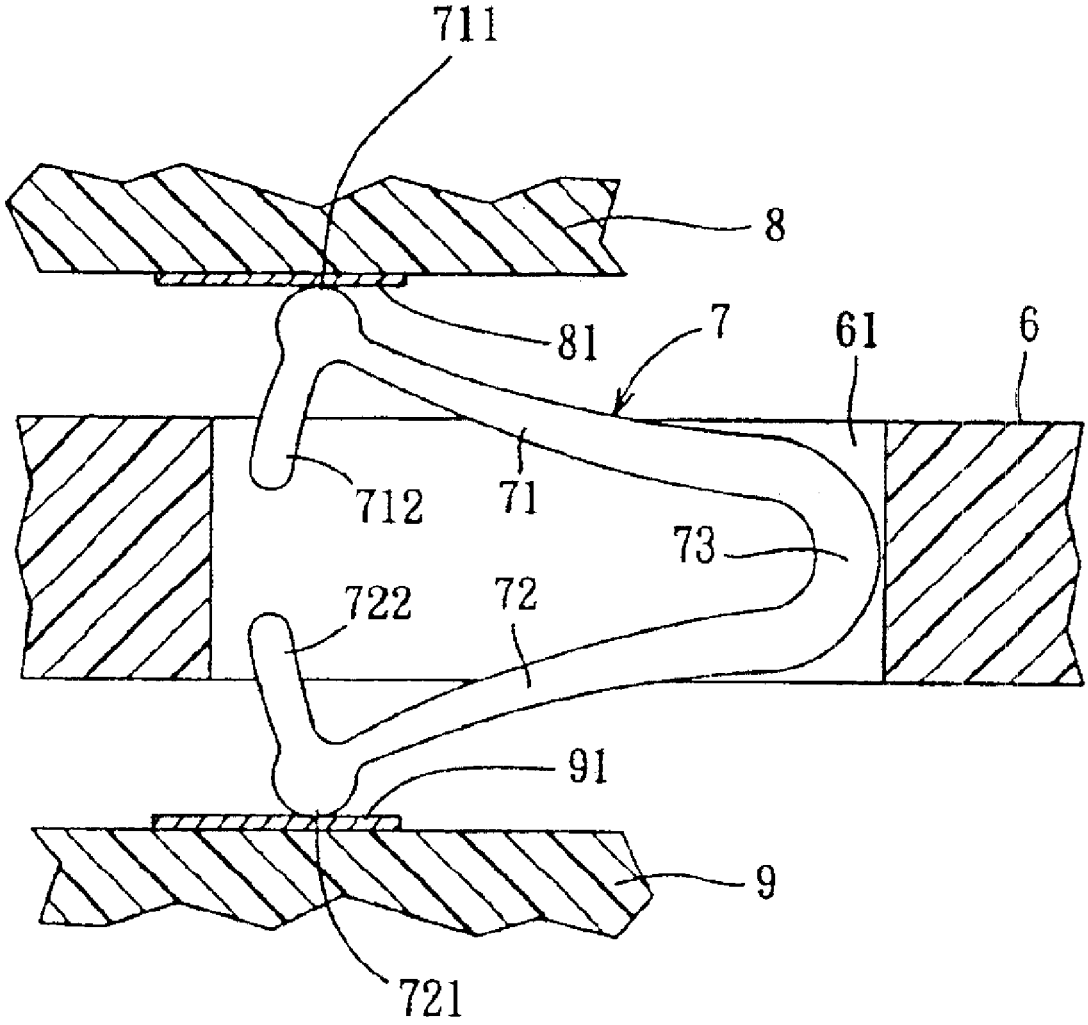
FIG. 1 PRIOR ART
FIG. 1 is a schematic view to illustrate the structure of a conventional conductive terminal applied to an LGA electrical connector.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

Figure 2:
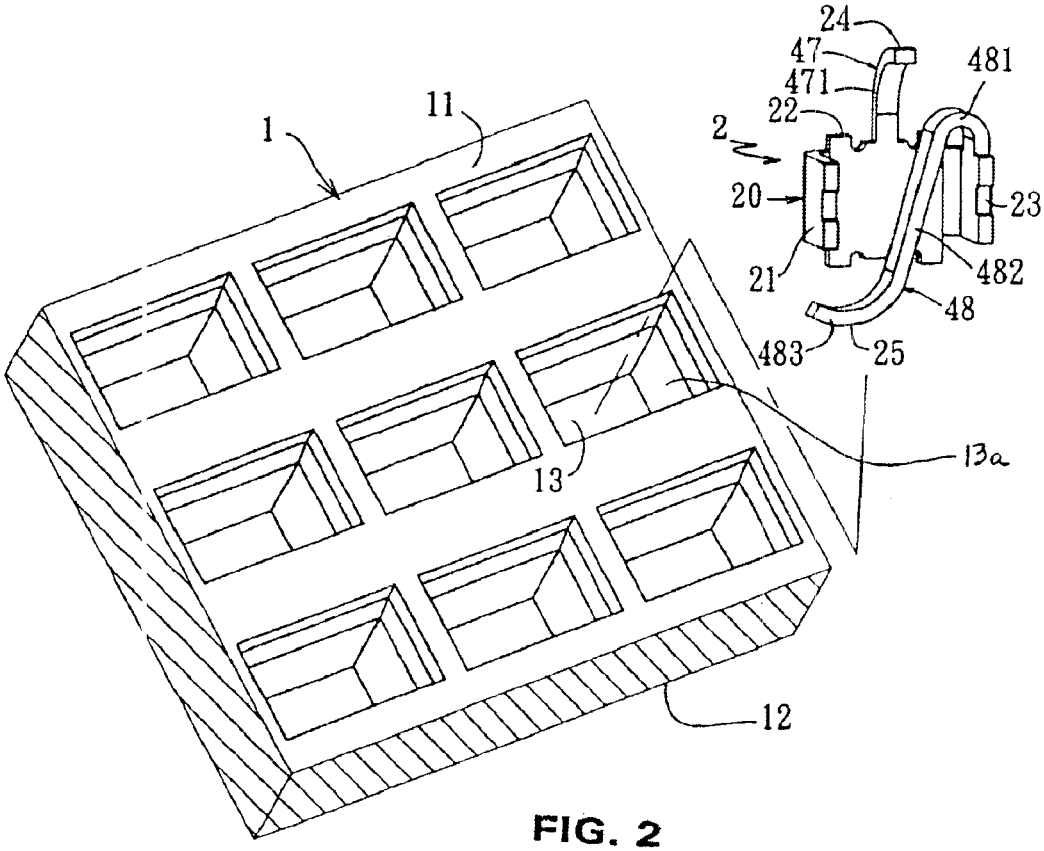
FIG. 2 is a perspective view of the structure of the first preferred embodiment of a conductive terminal according to this invention, illustrating schematically the configuration of an electrical connector formed by an assembly of the conductive terminal and an insulative housing.
Figure 3:
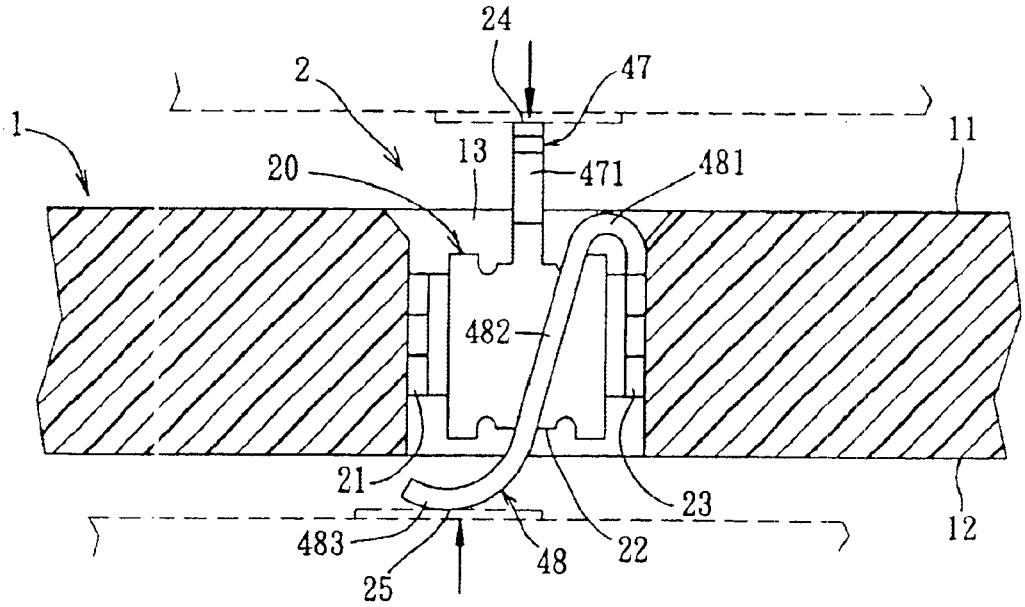
FIG. 3 is a schematic sectional side view of FIG. 2, illustrating the relative position relationship of the conductive terminal in the insulative housing.

Referring to FIGS. 2 and 3, similar to the aforesaid conventional structure, the first preferred embodiment of a conductive terminal and an electrical connector applying the conductive terminal according to this invention is used to connect an electronic component of an integrated circuit of a central processing unit (CPU) with a circuit board. A bottom side of the electronic component 4 has a plurality of contact pads 41 arranged thereon in an array, whereas a surface of the circuit board 5 is provided with a plurality of conductive contact pads 51 at positions corresponding to the contact pads. The electrical connector includes an insulative housing 1 and a plurality of conductive terminals 2.

The insulative housing 1 is formed with a first face 11 disposed at an upper side to be proximate to the electronic component, and a second face 12 disposed at a lower side to be proximate to the circuit board, and has a plurality of terminal receiving cavities 13 extending through the first face 11 and the second face 12. The position of each of the terminal receiving cavities 13 corresponds to the contact pads 41 of the electronic component 4 and the circuit board, and the shape of the space in each of the terminal receiving cavities 13 is defined by an inner wall surface 13*a*. In this embodiment, the terminal receiving cavity 13 is formed as a rectangular cavity.

Each of the conductive terminals 2 includes a base 20, and a first contact portion 24 and a second contact portion 25 which extend from the base 20 and which are capable of resilient restoration. In this embodiment, the base 20 is punched and bent from a metal plate into a U-shape, which is formed with a first sidewall 21, a second side wall 22, and a third sidewall 23 that are adjacent and substantially perpendicular relative to one another. The first sidewall 21 and the third sidewall 23 are located on the same side as the second sidewall 22 and are opposite to each other in a spaced-apart relationship. In actual assembly, the first sidewall 21 and the third sidewall 23 can be slightly stretched outward relative to the second sidewall 22. After the base 20 is inserted into the corresponding terminal receiving cavity 13, the first sidewall 21 and the third sidewall 23 press against the inner wall surface defining the terminal receiving cavity 13 such that a resilient restoring force is generated at the first sidewall 21 and the third sidewall 23 so as to enable the base 20 to engage with the inner wall surface, thereby positioning each conductive terminal in the corresponding terminal receiving cavity 13.

Further, the first sidewall 21, the second sidewall 22, and the third sidewall 23 are each formed with a first edge (21*a*, 22*a*, 23*a*, respectively) proximate to the first face 11 of the insulative housing 1, and a second edge (21*b*, 22*b*, 23*b*, respectively) proximate to the second face 12 of the insulative housing 1 in the direction of extension of the terminal receiving cavity 13. A first resilient arm 47 extends from the second sidewall 22. A second resilient arm 48 extends from the third sidewall 23. The first resilient arm 47 has a first curved section 471 bent away from the first edge 22*a* of the second sidewall 22 proximate to the first face 11 of the insulative housing 1 toward the middle between the first sidewall 21 and the third sidewall 23 and projecting outwardly of the first face 11. A part of the first curved section 471 which is proximate to a distal end thereof is a free end capable of resilient restoration. The second resilient arm 48 has a turned section 481 bent away from the first edge 23*a* of the third sidewall 23 proximate to the first face 11 of the insulative housing 1 in the direction of the first sidewall 21, a slanting section 482 connected to the other end of the turned section 481 and passing between the first sidewall 21 and the third sidewall 23 to extend obliquely in the direction of the second face 12 of the insulative housing 1, and a second curved section 483 connected to the other end of the slanting section 482, protruding outwardly of the second face 12, and bent in the direction of the second edge 21*b* of the first sidewall 21. The second curved section 483 is a free end capable of resilient restoration. The first contact portion 24 is located on the first curved section 471, and the second contact portion 25 is located on the second curved section 483. The first contact portion 24 and the second contact portion 25 respectively contact the electronic component 4 and the circuit board 5 to establish electrical connection.

When the electrical connector is interposed between the electronic component and the circuit board such that they are proximate to each other, the first contact portion 24 of the conductive terminal 2 electrically contacts the contact pad 41 of the electronic component 4, and the second contact portion 25 electrically contacts the contact pad 51 of the circuit board 5 such that the first resilient arm 47 and the second resilient arm 48 can be compressed to generate a resilient restoring force, thereby strengthening the electrical contact characteristics of the first contact portion 24 and the second contact portion 25.

Figure 4:
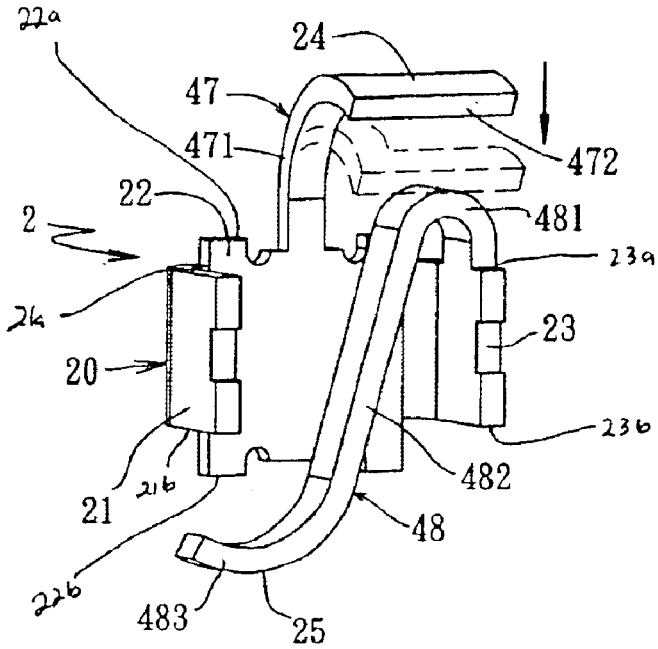
FIG. 4 is a perspective view showing the structure of the second preferred embodiment of a conductive terminal according to this invention.
Figure 5:
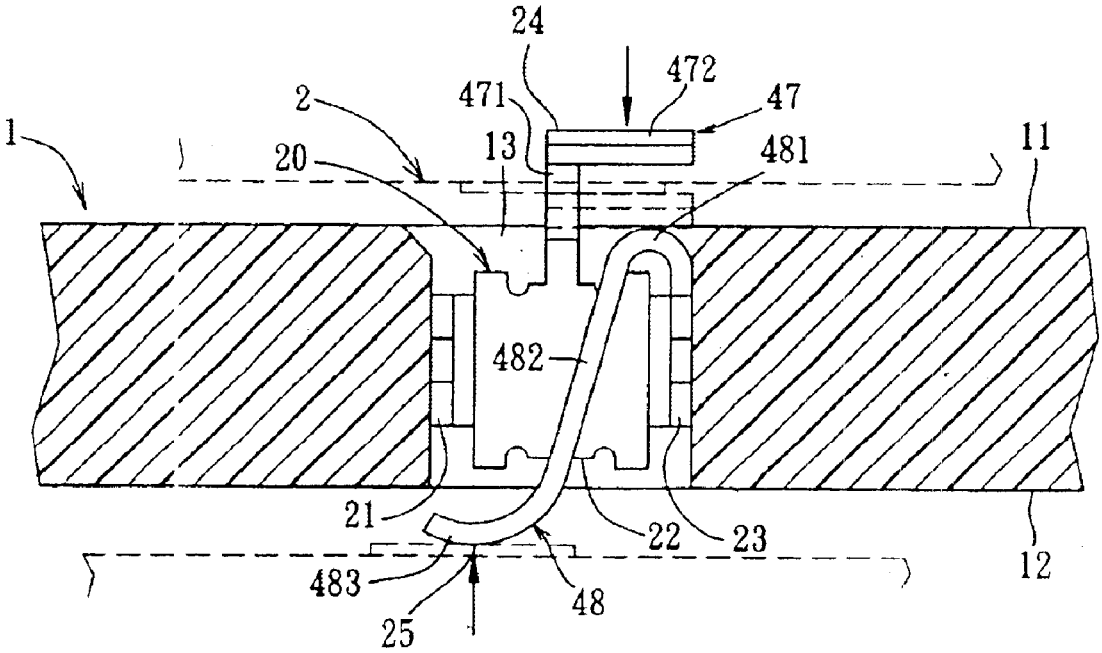
FIG. 5 is a schematic sectional side view of FIG. 4, illustrating the relative position relationship of the conductive terminal in the insulative housing.

With further reference to FIGS. 4 and 5, the first resilient arm 47 further has a horizontal section 472 extending transversely from the distal end of the first curved section 471 in the direction of the third sidewall 23. The horizontal section 472 is spacedly located above the turned section 481 of the second resilient arm 48 when not subjected to a force. When the first curved section 471 is pressed, the horizontal section 472 can be resiliently restored to contact the turned section 481 so as to establish electrical contact, thereby shortening the conducting path between the electronic component and the circuit board, and reducing the resistance value to enhance signal transmission reliability.

To sum up, in the conductive terminal and the electrical connector applying the same according to this invention, with the configuration of the conductive terminal which can resiliently contact the electronic component and the circuit board, not only the electrical contact characteristic can be strengthened, preferably, the signal transmission reliability can also be enhanced. Thus, the object of this invention can indeed be met.

However, what are described hereinabove are merely preferred embodiments of this invention, in which although the base of the conductive terminal is illustrated as having a U-shape, the use of two substantially L-shaped sidewalls that are adjacent to each other at 90 degrees to enable the first resilient arm and the second resilient arm to extend from the edge of one of the sidewalls may also achieve the aforesaid object. Therefore, the embodiments should not be based upon to limit the scope of this invention in practice.

What is claimed is:

1. A conductive terminal, which is positioned in an insulative housing to be electrically connected to an electronic component and a circuit board, the insulative housing being formed with a first face and a second face which are opposite to each other, and having a plurality of terminal receiving cavities extending through the first face and the second face, each conductive terminal including a base for abutting against the corresponding terminal receiving cavity to achieve positioning, characterized in that:

the base has two sidewalls that are adjacent to each other at an angle, each of the sidewalls being formed with a first edge and a second edge which are opposite to each other and which are disposed in a direction of extension of the terminal receiving cavity, a first resilient arm extending from the first edge of one of the sidewalls, a second resilient arm extending from the first edge of the other one of the sidewalls such that the first resilient arm extends outwardly in a direction away from the corresponding sidewall to form a first contact portion at a free end, the second resilient arm being bent to pass between the two sidewalls to form a second contact portion at a free end, the first contact portion and the second contact portion being respectively disposed on two sides of the base;

the first contact portion projecting outwardly of a plane in which the first face of the insulative housing lies, the second contact portion projecting outwardly of a plane in which the second face of the insulative housing lies, the first contact portion and the second contact portion contacting respectively and electrically the electronic component and the circuit board to enable signal transmission between the electronic component and the circuit board through the conductive terminal.

2. The conductive terminal as recited in claim 1, wherein the first resilient arm has a first curved section extending bendingly and outwardly from the first edge of the sidewall, and the second resilient arm has a turned section bent away from the first edge of the other one of the sidewalls, a slanting section connected to the other end of the turned section and extending obliquely to pass between the two side walls, and a bendingly extending second curved section connected to the other end of the slanting section such that the first contact portion is located on the first curved section and the second contact portion is located on the second curved section.

3. The conductive terminal as recited in claim 2, wherein the first resilient arm further has a horizontal section extending transversely from the other end of the first curved section, the horizontal section being capable of resiliently contacting and being spacedly adjacent to the turned section of the second resilient arm.

4. The conductive terminal as recited in claim 2, wherein the base is formed with a first sidewall, a second sidewall, and a third sidewall, which form angles thereamong and which are adjacent to one another in a generally U-shape, the first sidewall and the third sidewall being opposite to each other in a spaced-apart relationship, the first curved section of the first resilient arm extending bendingly from the first edge of the second sidewall, the turned section of the second resilient arm extending bendingly from the first edge of the third sidewall, the slanting section passing between the first sidewall and the third sidewall.

5. The conductive terminal as recited in claim 1, wherein the angle between the adjacent sidewalls if 90 degrees.

6. The conductive terminal as recited in claim 2, wherein the bent section is located completely within the terminal receiving cavity.

7. An electrical connector adapted to provide electrical connection between an electronic component and a circuit board, the electrical connector comprising:

an insulative housing formed with a first face and a second face which are opposite to each other, and having a plurality of terminal receiving cavities extending through the first face and the second face, each of the terminal receiving cavities being defined by a corresponding inner wall surface; and a plurality of conductive terminals disposed in the corresponding terminal receiving cavities, each of the conductive terminals including:

a base having two adjacent sidewalls that form an angle, each of the sidewalls having a first edge proximate to the first face of the insulative housing and a second edge proximate to the second face of the insulative housing in a direction of extension of the terminal receiving cavity, the base abutting against the inner wall surface of the corresponding terminal receiving cavity to achieve positioning;

a first resilient arm extending outwardly and bendingly from the first edge of one of the sidewalls of the base in a direction away from the sidewall and forming, at a free end, a first contact portion which is capable of resilient restoration and which projects outwardly of a plane in which the first face lies;

a second resilient arm extending and bent away from the first edge of the other one of the sidewalls to pass between the two sidewalls and forming, at a free end, a second contact portion which is capable of resilient restoration and which projects outwardly of a plane in which the second face lies;

the first contact portion and the second contact portion electrically contacting the electronic component and the circuit board, respectively, to enable signal transmission between the electronic component and the circuit board through the conductive terminals.

8. The electrical connector as recited in claim 7, wherein the first resilient arm of the conductive terminal has an outwardly and bendingly extending first curved section connected to the first edge of said one of the sidewalls, the second resilient arm having a bent turned section connected to the first edge of said other one of the sidewalls, a slanting section connected to the other end of the bent section and extending obliquely to pass between the two sidewalls, and a bendingly extending second curved section connected to the other end of the slanting section such that the first contact portion is located on the first curved section and the second contact portion is located on the second curved section.

9. The electrical connector as recited in claim 8, wherein the first resilient arm of the conductive terminal further has a horizontal section extending transversely from the other end of the first curved section, the horizontal section being capable of resiliently contacting and being spacedly adjacent to the turned section of the second resilient arm.

10. The electrical connector as recited in claim 8, wherein the base of the conductive terminal is formed with a first sidewall, a second sidewall, and a third sidewall, which form angles thereamong and which are adjacent to one another in a U-shape, the first sidewall and the third sidewall being opposite to each other in a spaced-apart relationship, the first curved section of the first resilient arm extending from the second sidewall, the turned section of the second resilient arm extending from the third sidewall, the slanting section passing between the first sidewall and the third sidewall.

11. The electrical connector as recited in claim 7, wherein the angle between the adjacent sidewalls if 90 degrees.

12. The electrical connector as recited in claim 8, wherein the bent section is located completely within the terminal receiving cavity.

* * * * *